US007568422B1

(12) United States Patent
Barrett

(10) Patent No.: US 7,568,422 B1
(45) Date of Patent: Aug. 4, 2009

(54) BOLT OPERATION FACILITY FOR AUTOLOADING FIREARM

(76) Inventor: Christopher Gene Barrett, 8634 E. Gum Rd., Murfreesboro, TN (US) 37127

( * ) Notice: Subject to any disclaimer, the term of this patent is extended or adjusted under 35 U.S.C. 154(b) by 210 days.

(21) Appl. No.: 11/541,286

(22) Filed: Sep. 28, 2006

(51) Int. Cl.
*F41A 3/26* (2006.01)
*F41A 3/40* (2006.01)

(52) U.S. Cl. ..... 89/180; 89/190

(58) Field of Classification Search ..... 89/167, 89/168, 169, 173, 174, 175, 176, 180, 186, 89/187.01, 189, 190
See application file for complete search history.

(56) References Cited

U.S. PATENT DOCUMENTS 2,481,548 A * 9/1949 Waltke, Jr. ..... 89/174
2,881,547 A * 4/1959 Butler ..... 42/16
2,941,449 A * 6/1960 Reed ..... 89/185
2,951,424 A * 9/1960 Stoner ..... 89/179
4,154,142 A * 5/1979 Schwegler ..... 89/11
4,358,986 A * 11/1982 Giorgio ..... 89/142
4,655,118 A * 4/1987 Bruderer et al. ..... 89/185
4,677,897 A * 7/1987 Barrett ..... 89/166
4,867,040 A 9/1989 Barrett
4,920,855 A * 5/1990 Waters ..... 89/172
6,182,389 B1 * 2/2001 Lewis ..... 42/16
6,343,536 B1 * 2/2002 Rossier et al. ..... 89/161
6,609,319 B1 * 8/2003 Olson ..... 42/16
6,851,346 B1 * 2/2005 Herring ..... 89/1.4

* cited by examiner

*Primary Examiner*—Bret Hayes
(74) *Attorney, Agent, or Firm*—Bennet K. Langlotz; Langlotz Patent & Trademark Works, Inc.

(57) ABSTRACT

A semiautomatic rifle has a housing defining a housing axis and containing a bolt assembly that reciprocates along the housing axis. The bolt assembly has a bolt carrier and a bolt, which reciprocates axially with respect to the carrier. A barrel is connected to the housing, and has a rear portion having a locking chamber that removably receives part of the bolt. An arm element interconnects the bolt carrier and the bolt, and operates to extend the bolt in response to rearward movement of the bolt carrier within the housing. The arm may be pivotally connected to the bolt carrier. The bolt may include a rod external of the bolt carrier, having a rear end contacting the arm, and a forward end contacting the rear of the barrel.

20 Claims, 3 Drawing Sheets

BOLT OPERATION FACILITY FOR AUTOLOADING FIREARM

FIELD OF THE INVENTION

This invention relates to autoloading firearms, and more particularly to bolt operation.

BACKGROUND AND SUMMARY OF THE INVENTION

U.S. Pat. No. 4,867,040 discloses a prior art semiautomatic rifle having a self unlocking device, (SUD) and is hereby incorporated by reference. The disclosed rifle design has been extremely successful for every intended application. However, for certain limited applications for which it was not intended, it is subject to malfunction, premature wear or breakage.

The prior art rifle may experience operating failures when certain types of muzzle-mounted sound suppressors are employed. Essentially, a sound suppressor temporarily retains much of the expanding propellant gases that would normally be immediately dispersed at the muzzle. The auto loading firearm unlocks its bolt as soon as the bore pressure drops to a safe level, but when shooting with a suppressor, some of the gas pressure is returned back through the bore of the barrel. This retrograde pressure wave acts on the empty cartridge casing, pushing it rearward like a piston. Thus, instead of the rearward motion of the bolt extracting the casing with tension and thereby absorbing some of the bolt's recoil energy, the recoil energy of the bolt is increased, which can cause enhanced wear or damage to various components such as buffers, magazine lips, and a carrier-to-bolt latch.

The retrograde pressure wave may prevent the bolt from properly extending, as would happen during extraction. Bolt extension is normally assured by a spring that biases the bolt away from the bolt carrier. However, the excessive pressure on the bolt face overwhelms the biasing force of the bolt spring. This can prevent a latch on the bolt carrier from engaging the bolt and locking it in an extended position while the bolt is recoiling and feeding a subsequent cartridge from the magazine. In addition, when the latch does engage, the force of the rearwardly-driven casing is transmitted from the bolt via the latch to the bolt carrier. The latch is not intended for transmitting such substantial forces, and is vulnerable to excessive wear and damage that may render it nonfunctional for its normal latching purpose.

In addition to the limited ability to withstand high bolt face pressures caused by the sound suppressors, the prior art rifle requires a bolt latch, a spring to bias the bolt latch, and a bolt spring, increasing the complexity of the bolt assembly, with the inherent disadvantages of complexity in any mechanical system.

The present invention overcomes the limitations of the prior art by providing a semiautomatic rifle having a housing containing a bolt carrier assembly that reciprocates along the housing axis. The bolt carrier assembly has a bolt, and reciprocates axially with respect to the carrier. A barrel is connected to the housing, and has a rear portion having a locking chamber that removably receives part of the bolt. An arm element interconnects the bolt carrier and the bolt, and operates to extend the bolt in response to rearward movement of the bolt carrier within the housing. The arm may be pivotally connected to the bolt carrier. The bolt carrier may include a rod internal of the bolt carrier, having a rear end contacting the arm, a mid section contacting the rear of the bolt via the bolt extender, and a forward end contacting the rear of the barrel.

DETAILED DESCRIPTION OF A PREFERRED EMBODIMENT

Figure 1:
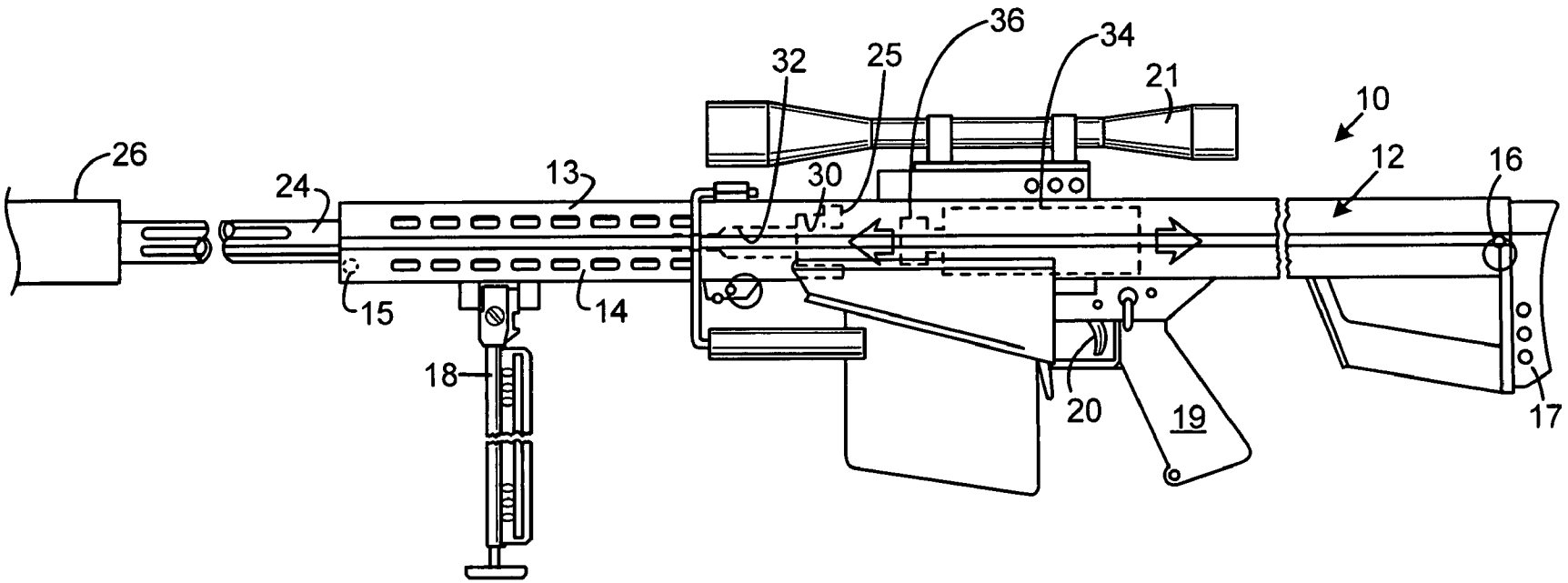
FIG. 1 is a side view of a rifle according to a preferred embodiment of the invention.

FIG. 1 shows a semi-automatic rifle 10 made in accordance with this invention, including a housing 12 having an upper receiver 13 and a lower receiver 14. The receivers 13 and 14, preferably separable, may be detachably joined about their front ends about a hinge bar 15, and secured at the mid and rear end by the locking pin 16. When the receivers 13 and 14 are secured together they form the housing 12, and preferably have a hexagonal cross-section, although almost any cross sectional shape may be used, preferably one that prevents unwanted rotation of the bolt.

The lower receiver 14 is provided with a rear stock member 17, a front bipod 18, an intermediate depending hand grip 19 and trigger 20. The upper receiver 13 may be provided with a sight, such as the telescopic sight 21. An elongated barrel 24 has an enlarged rear end or barrel extension 25, and the barrel is slidably received within the housing to reciprocate between a forward position and a rearward recoil position. The barrel is spring biased to the forward position, and limited in its reciprocation range by cushioned stops or buffers (not shown). A muzzle attachment 26 such as a sound suppressor, flash hider, or muzzle brake is removably attached at a forward muzzle end of the barrel.

The rear end of the barrel extension defines a locking chamber 30 and barrel chamber 32 for receiving a cartridge 92.

Also received within the housing 12 behind the rear barrel extension end face 25 is an elongated bolt carrier 34 to which is connected a bolt 36. The bolt has a bolt head that is receivable within the locking chamber 30, and which rotates with respect to the bolt carrier to lock within the chamber 30 to secure a cartridge within the chamber 32 during discharge. The bolt extends and retracts longitudinally or axially with respect to the bolt carrier, and a cam mechanism connecting the bolt and carrier provides rotation of the bolt to engage the locking chamber when the bolt moves to a retracted position with respect to the bolt carrier, such as occurs when the bolt carrier moves forward to a battery position.

Figure 2:
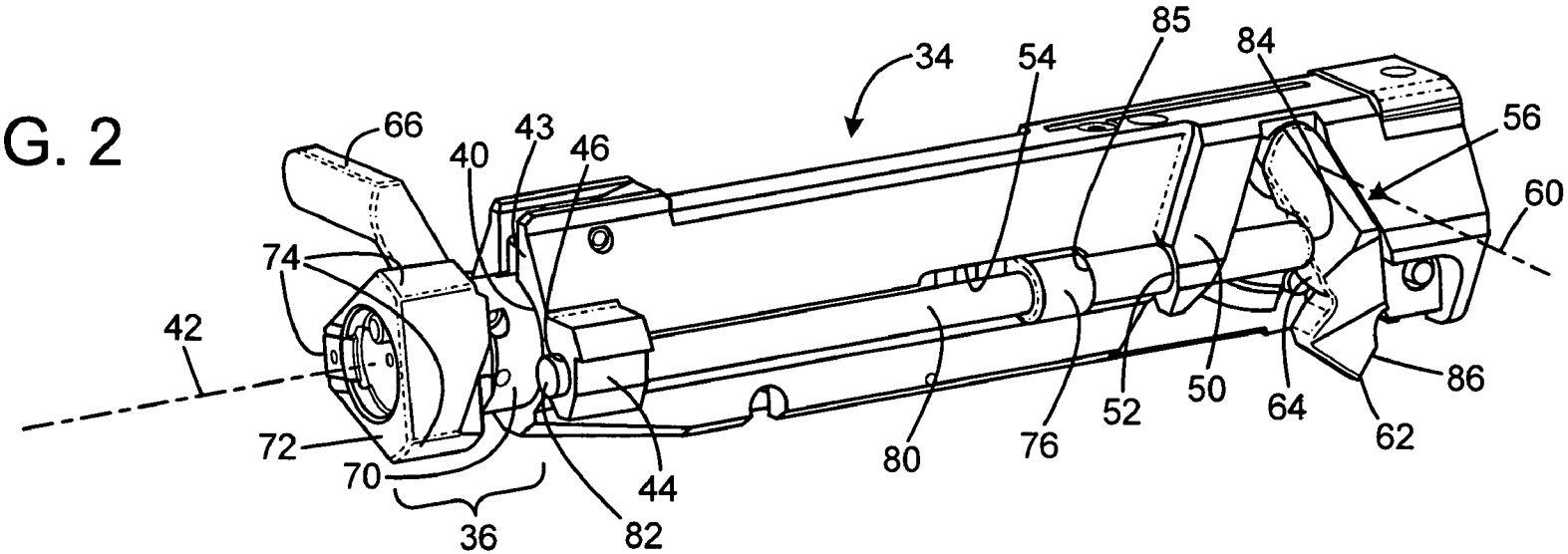
FIG. 2 is a perspective view of a bolt assembly in a locked condition according to a preferred embodiment of the invention.
Figure 3:
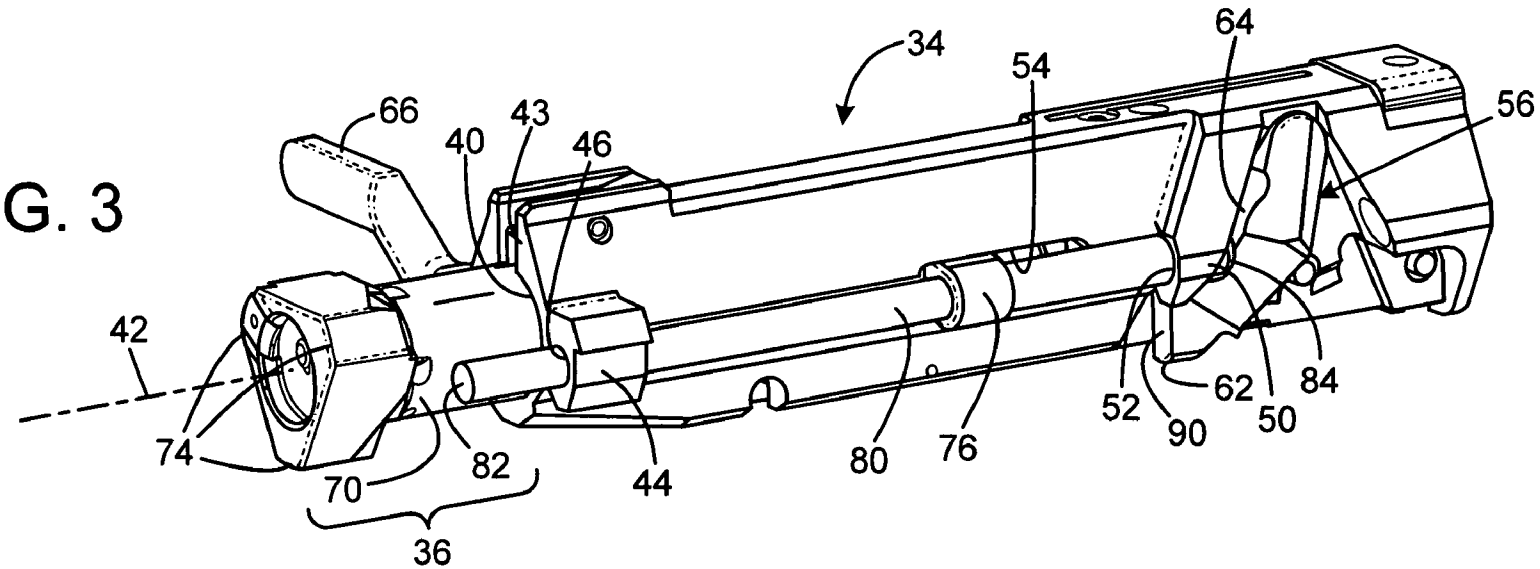
FIG. 3 is a perspective view of a bolt assembly in an unlocked condition according to a preferred embodiment of the invention.

FIG. 2 illustrates the bolt carrier 34 and bolt 36 in a locked condition in which the bolt is retracted with respect to the carrier and rotated to engage the locking chamber. FIG. 3 shows the bolt carrier 34 and bolt 36 in an unlocked condition in which the bolt is extended with respect to the carrier, and rotationally positioned for axial movement into and out of the locking chamber.

The bolt carrier 34 is an elongated body defining a cylindrical bore 40 opening in a forward direction, and aligned with a major axis 42 that coincides with the center of the barrel's bore. The bore 40 extends a major portion of the length of the bolt carrier. The bolt carrier has a forward face 43, and a protruding forward boss 44 at the forward end. The boss 44 extends laterally in a leftward direction, when viewed from a frame of reference from the rear of the bolt carrier. The boss defines a cylindrical bore 46 that is parallel with the axis 42. A rear boss 50 also protrudes from a leftward side of the bolt carrier at an intermediate location near the rear of the carrier, and defines a bore 52 coaxial with and having the same size as or 46. An elongated slot 54 is defined in the left side of the bolt carrier, and provides communication into the bolt bore 40. The slot 54 is positioned at an intermediate location between the forward and rear bosses 44, 50.

An arm or self-unlocking device (SUD) lever 56 has an upper end pivotally connected to the body of the bolt carrier 34. The arm includes a pin (not shown) that defines a horizontal axis 60 transverse to the axis of the bolt carrier, and about which the arm pivots. The (SUD) arm is an elongated element with a free end 62 that extends below the level of the bottom of the bolt carrier. The arm has a convex cylindrical or arcuate forward surface 64 at an intermediate portion, so that the surface 64 provides a cam surface having a generally forward facing surface aligned with the center of bores 46 and 52 as the arm pivots. A fixed charging handle 66 extends perpendicularly from the right side of the forward end of the bolt carrier.

The bolt 36 has an elongated cylindrical body 70 that is closely received within the bolt carrier bore 40. The forward end of the bolt is a bolt head 72 having preferably, a triangular shape with three radially protruding lugs 74 that operate to lock into the locking chamber. Other bolt head shapes may be employed as well. The bolt has other operational features that are well-known in the art, and/or which are described in the reference incorporated above. A rear portion of the bolt makes contact with the bolt extender or link 76 that extends through the bolt carrier slot 54. A rod 80 is inserted through the bolt extender, and extends parallel to the axis 42. The rod is slidably received within bosses 44 and 50 on the bolt carrier. The rod has a forward end 82 and a rear end 84. The rod has a forward portion having a first diameter and a rear portion with a larger diameter, so that a shoulder 85 is formed in the middle, for the rear face of bolt extender 76 to firmly contact during transmission of force from one to the other. The forward end of the rod operates to contact the rear face of the barrel, as will be discussed in detail below, the middle shoulder operates to contact the bolt via the bolt extender, and the rear end operates to contact the arm surface 64. Not shown is a helical slot on the bolt carrier and pin on the bolt that interact to provide rotation of the bolt in response to its extension and retraction.

In FIG. 2, the bolt is shown in a locked condition in which it is retracted into the bolt carrier, so that the bolt extender 76 is at the rear end of slot 54. In this position, the rod end 84 has pushed the arm 56 into a rearward position, so that a rear face 86 at the lower end 62 of the arm is approximately vertical. The forward end 82 of the rod 80 is retracted, so that it protrudes only a limited amount beyond the face 43 of the bolt carrier 34. The bolt head is in a rotational position in which it is locked with respect to the locking chamber, which is to say that it cannot be axially retracted from the locking chamber. When the arm is in the rearward position, it extends below the level of the lower surface of the bolt carrier.

In FIG. 3, the bolt is shown in an unlocked condition in which it is extended from the bolt carrier, so that the bolt extender 76 is that the forward end of slot 54. In this position, the rod end 84 has been pushed forward by the arm 56. The arm is in a forward position, so that a forward face 90 at the lower end 62 of the arm is approximately vertical. The forward end 82 of the rod 80 is extended, so that it protrudes a significant amount beyond the face 43 of the bolt carrier 34. The bolt is in a rotational position in which it is unlocked with respect to the locking chamber, so that the bolt may be inserted into, or withdrawn from the locking chamber. When the arm is in the forward position, it does not extend below the level of the lower surface of the bolt carrier.

FIGS. 4A-D illustrate in a simplified manner the operation of the bolt and bolt carrier.

Figures 4A, 4B, 4C, 4D:
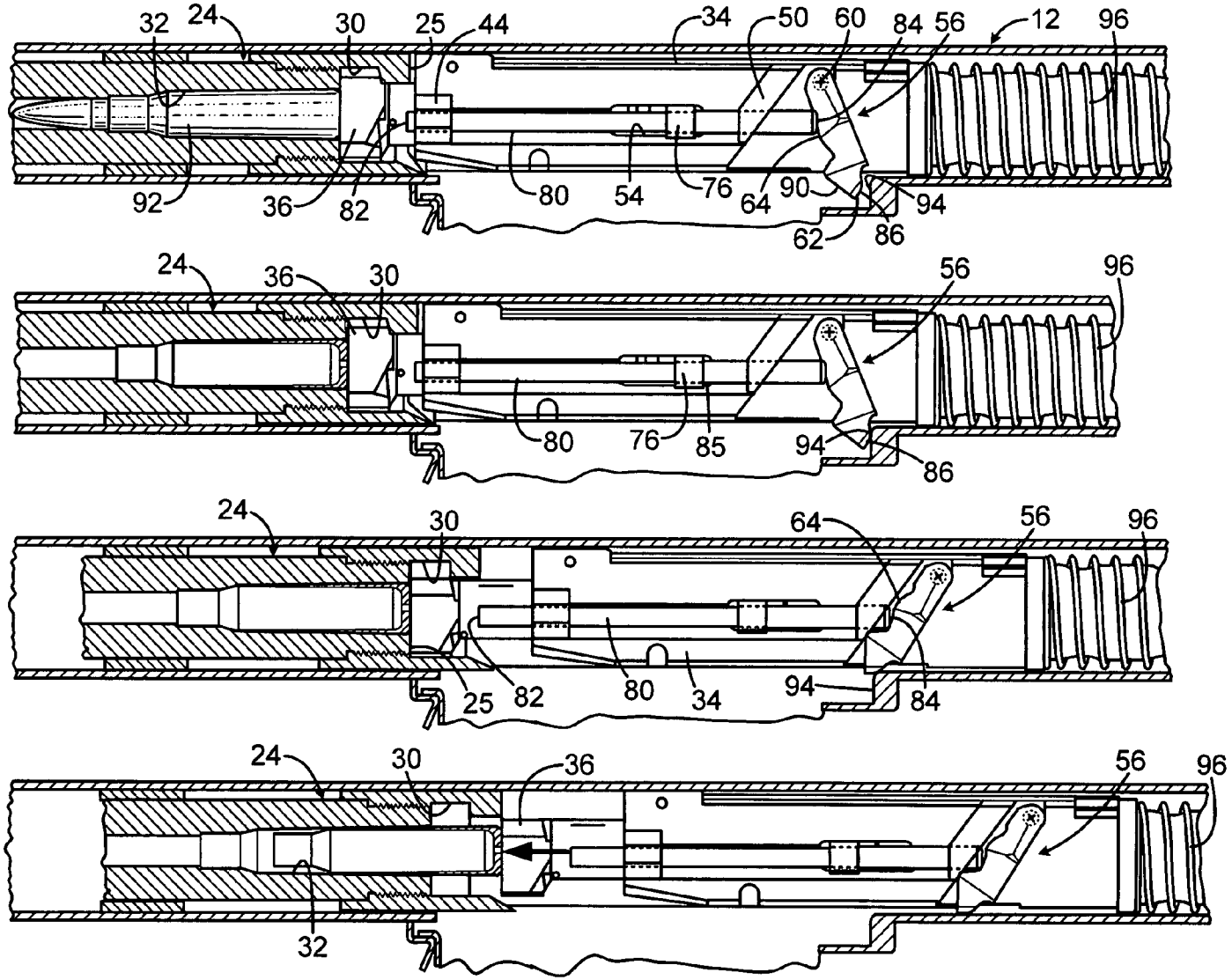
FIGS. 4A-4D are simplified sectional side views of the preferred embodiment, showing a sequence of operation.

In FIG. 4A, the system is "in battery", which is the condition in which a cartridge 92 is loaded within the chamber 32 and the bolt and bolt carrier are ready for firing in response to a pull of the trigger 20. The bolt 36 is in the retracted position with respect to the bolt carrier 34, and is rotationally locked within the locking chamber 30 against rearward axial extraction. The forward end 82 of rod 80 is contacting the rear face 25 of the barrel 24. The lower end 62 of arm 56 is forward of a step 94 on the interior of the housing 12. A recoil spring 96 is in an extended condition.

FIG. 4B shows the rifle action a brief interval after the firearm is discharged. At this moment the barrel 24 has shifted rearward from the forward position of FIG. 4A, The bolt of 36 remains locked in the locking chamber 30 and in the retracted position. The rearward movement of the barrel carries the bolt and bolt carrier rearward until the arm surface 86 has just contacted the housing step 94. The rod 80 remains in the rearward position along with the bolt. The recoil spring 96 has been partially compressed by the rearward movement of the bolt carrier.

FIG. 4C shows the rifle action an additional interval later. The arm 56 has contacted the step and pivoted forward as the bolt carrier continued rearward, pushing the rod 80 forward. The link 76 has moved from the rear of the slot 54 to the forward end. This unlocks the bolt head from the locking chamber 30. Although at this moment they have not yet moved away, the bolt and carrier are now about to move rearward together away from the barrel. During the transition from FIG. 4B to FIG. 4C, the arm 56 has been shifted to the forward position by its contact with step 94. This has served to extend the rod 80 as surface 64 bears on the rear end 84 of the rod. By the engagement of the rod's step 85 on the link 76, the bolt is moved forward with respect to the bolt carrier. Because the rod's step 85 is equally pushing against the bolt, this serves to extend the bolt, causing it to rotate due to the helical engagement of the bolt to the carrier.

The extended bolt is held in a locked extended position, which is important in conditions in which there is excessive pressure against the forward face of the bolt. Such pressure may be due to back pressure in the barrel from a muzzle mounted sound suppressor, and could otherwise prevent the bolt from fully extending as would normally happen without such bolt face pressure. Even when the pressure on the bolt face would generate compression between the bolt and carrier, the effect of the arm and rod is to separate these two components. The recoil spring 96 has been further compressed by rearward movement of the bolt carrier.

FIG. 4D shows the rifle action with the bolt carrier in the fully rearward position, maximally compressing spring 96, and with the barrel 24 returned to battery. After the extraction of the cartridge case has occurred, the barrel will connect with its mechanical stop, halting the rearward motion and then begin returning to battery due to the barrel return springs (not shown). The barrel will return to its battery position before the bolt carrier reaches its full rearward position, preparing it to receive the next cartridge in the magazine. The casing from the fired cartridge (not shown) has been extracted from the chamber 32 and ejected from the housing. The bolt 36 is far enough back that it is rearward of a cartridge (not shown) that is to be loaded in the chamber as the bolt carrier cycles forward in response to the compressed spring 96.

As the bolt and bolt carrier return forward, the sequence of operation is reversed. The bolt enters the chamber 30, and the end 82 of rod 80 strikes the barrel face 25 as shown in FIG. 4C. The momentum of the bolt carrier continues forward, causing the bolt to move into the bolt carrier, thereby rotating it into the locked position, and shifting the rod rearward to move the arm 56 to the rearward position shown in FIG. 4B.

There is no spring interacting between the bolt carrier and the bolt. The bolt is unbiased with respect to the bolt carrier, and is shifted in position based on the position of the bolt carrier in the rifle. When the bolt carrier moves rearward, the action of the arm 56 extends the bolt. When the bolt carrier reaches the rear face of the barrel, the action of the bolt head against the surface within the locking chamber serves to retract the bolt, as does the effect of the rod face 82 striking the rear surface 25 of the barrel.

Even excessive pressure on the bolt face, such as provided in the circumstances described above, will not cause the bolt to shift to the retracted position, because the arm in the forward position shown in FIGS. 4C and 4D prevents the rod from shifting rearward.

While the above is discussed in terms of preferred and alternative embodiments, the invention is not intended to be so limited.

The invention claimed is:

1. A semi-automatic rifle comprising:

an elongated housing defining an axis and containing a bolt assembly operable for reciprocation along the axis;

the bolt assembly comprising a bolt carrier and a bolt;

the bolt being operable for axial reciprocation with respect to the bolt carrier;

an elongated barrel connected to the housing and having a rear portion defining a locking chamber operable to removably receive a portion of the bolt;

an arm element pivotally connected to the bolt carrier and operably engaged to the bolt; and the arm element being operable in response to rearward movement of the bolt carrier to extend the bolt.

2. The rifle of claim 1 wherein the arm element is pivotally connected to the bolt carrier and pivots on a pivot axis that is fixed with respect to the bolt carrier.

3. The rifle of claim 1 wherein the arm element is an elongated member connected to the bolt carrier at a first end.

4. The rifle of claim 1 wherein the arm element has a protruding portion positioned to strike a stop element within the housing when the bolt carrier is in a rearward position.

5. The rifle of claim 1 wherein the arm element has a first end pivotally connected to the bolt carrier, an opposite end operable to selectably contact a portion of the housing, and an intermediate portion operable to contact a portion of the bolt.

6. The rifle of claim 1 wherein the bolt carrier defines an axial slot, and wherein the bolt includes an axial rod connected to the bolt by a link element extending through the slot, the rod having a rear end adjacent to the arm element.

7. The rifle of claim 6 wherein the rod has a forward end operable to contact a rear portion of the barrel.

8. The rifle of claim 1 wherein the bolt includes a bolt head operable to be received within the locking chamber, and wherein the bolt further includes a forward protrusion laterally offset from the bolt head and operable to contact a rear surface of the barrel.

9. The rifle of claim 1 wherein the bolt assembly reciprocates between a forward battery position with respect to the barrel in which the bolt head engages the locking chamber, and a rearward recoil position in which the bolt assembly is spaced apart from the barrel.

10. The rifle of claim 9 wherein the arm element operates immediately in response to rearward movement from the battery position to move the bolt with respect to the bolt carrier.

11. The rifle of claim 10 wherein the barrel is axially movable with respect to the housing, such that during an initial recoil phase in which a bullet passes through and exits the barrel, the bolt remains engaged in the locking chamber, and remains in a fixed position with respect to the bolt carrier.

12. The rifle of claim 1 wherein the bolt and bolt carrier are connected to each other entirely by rigid elements, such that no spring is connected both to the bolt carrier and to the bolt to generate a spring biasing force between the bolt and bolt carrier.

13. The rifle of claim 1 wherein the bolt is unbiased with respect to the bolt carrier, such that the bolt assembly is free of biasing force that would resist retraction of the bolt into the carrier when be bolt assembly moves to a forward battery position in which the bolt engages the locking chamber.

14. A semi-automatic rifle comprising:

an elongated housing defining an axis and containing a bolt assembly operable for reciprocation along the axis;

the bolt assembly comprising a bolt carrier and a bolt;

the bolt being operable for axial reciprocation with respect to the bolt carrier;

the bolt being operable for rotation with respect to the bolt carrier in response to axial reciprocation;

an elongated barrel connected to the housing and having a rear portion defining a locking chamber operable to removably receive a portion of the bolt;

the bolt being operable to move to an extended position in response to rearward movement of the bolt carrier;

an arm pivotally connected to the bolt carrier and operable to move in response to contacting a portion of the housing; and wherein the bolt has a contact portion adjacent to a portion of the arm, such that movement of the arm generates movement of the bolt.

15. The rifle of claim 14 wherein the bolt and bolt carrier are connected to each other entirely by rigid elements, such that no spring is connected both to the bolt carrier and to the bolt to generate a spring biasing force between the bolt and bolt carrier.

16. The rifle of claim 14 wherein the bolt and bolt carrier are unbiased with respect to each other.

17. The rifle of claim 14 including an elongated rod external of the bolt carrier, operably engaged to the bolt, and having a rear end operable to contact the arm.

18. The rifle of claim 14 wherein the bolt includes including an elongated rod external of the bolt carrier, and having a forward end operable to contact a rear surface portion of the barrel.

19. A semi-automatic rifle comprising:

an elongated housing defining an axis and containing a bolt assembly operable for reciprocation along the axis;

the bolt assembly comprising a bolt carrier and a bolt;

the bolt being operable for axial reciprocation with respect to the bolt carrier;

the bolt being operable for rotation with respect to the bolt carrier in response to axial reciprocation;

an elongated barrel connected to the housing and having a rear portion defining a locking chamber operable to removably receive a portion of the bolt;

the bolt being operable to move to an extended position in response to rearward movement of the bolt carrier; and wherein the bolt assembly includes an elongated rod having a forward end operable to contact a rear surface portion of the bolt.

20. The rifle of claim 19 further comprising an arm pivotally connected to the bolt carrier and operable to move in response to contacting a portion of the housing; and wherein the rod has a rear end operable to contact the arm.

* * * * *